US006453130B1

(12) United States Patent
Richtsmeier

(10) Patent No.: US 6,453,130 B1
(45) Date of Patent: Sep. 17, 2002

(54) FUSING METHODS AND APPARATUS FOR IMAGE-PRODUCING DEVICES

(75) Inventor: Dean Richtsmeier, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/802,343

(22) Filed: Mar. 9, 2001

(51) Int. Cl.[7] ..... G03G 15/20
(52) U.S. Cl. ..... 399/69; 219/216; 399/330
(58) Field of Search ..... 399/67, 69, 320, 399/330; 219/216

(56) References Cited

U.S. PATENT DOCUMENTS 4,981,433 A * 1/1991 Matsumoto et al. ..... 219/216
5,153,615 A * 10/1992 Snelling
5,315,356 A * 5/1994 Nagato et al. ..... 219/216
5,481,346 A * 1/1996 Ohzeki et al. ..... 399/69
5,537,199 A * 7/1996 Takai et al.
5,581,341 A * 12/1996 Ianaka ..... 219/216
5,701,554 A * 12/1997 Tanaka et al. ..... 399/69
5,946,526 A * 8/1999 Kim ..... 219/216

* cited by examiner

*Primary Examiner*—Susan S.Y. Lee

(57) ABSTRACT

The invention includes apparatus and methods for fusing an image to a medium in conjunction with the use of an image-producing device. The image is formed by a substance which is applied to the medium, such as a toner. An apparatus in accordance with the present invention includes a heat source which is configured to increase in temperature while the image and supporting medium are exposed to the heat source. A method in accordance with the present invention includes providing a heat source and exposing the image and medium to the heat source while the temperature of the heat source is increased.

22 Claims, 5 Drawing Sheets

FUSING METHODS AND APPARATUS FOR IMAGE-PRODUCING DEVICES

FIELD OF THE INVENTION

This invention pertains to image-producing devices and more specifically to fusing an image to a medium in an image-producing device.

BACKGROUND OF THE INVENTION

Various types of prior art image-producing devices are known. When I say "image-producing device" I mean a device that is configured to produce a visual image and further configured to transfer the image to an image medium (medium). One relatively common type of image-producing device is known as a printer. However, it is understood that the term "image-producing device" includes any type of device, including copiers, facsimile machines, and the like.

Generally, image-producing devices are configured to produce images in one or more colors, including the "color" of black. These images are typically transferred to a medium which is in the form of paper sheets, although other forms of medium, such as transparencies and the like, are employed.

Image-producing devices usually employ one of several known methods of producing an image. Two popular methods of producing an image are known as "ink jet printing" and "laser printing." Both the ink jet printing method and the laser printing method are well known in the art. As the respective names imply, the ink jet method utilizes at least one jet of ink in producing an image, while the laser method utilizes at least one laser in producing an image.

Each method of producing an image has various advantages. One advantage of the laser method is that the image can be substantially bonded to the medium so as to be relatively smear-proof. That is, the laser method is capable of producing images that are generally known to be substantially fixed to the medium so that the image cannot be easily deformed or smeared. The method of fixing the image to the medium in the laser printing method is sometimes referred to as "fusing" the image to the medium.

The laser printing method can be broken down into several steps. A first step is the production of an image on a surface, such as a photoconductor or intermediate transfer surface, which is a component of the image-producing device. This step of producing the image on the surface usually comprises forming the image on the surface by depositing powdered toner onto the surface. A second step of the printing method is the transfer of the toner which makes up the image from the surface to a sheet of medium.

A third step of the printing method is fusing of the image to the sheet of medium. The step of fusing the image to the sheet of medium usually comprises heating the toner and medium to a given temperature to cause the toner to "fuse" to the medium. Generally, the temperature to which the toner is heated is sufficient to substantially melt the toner into a "plastic" state but not to a liquid state. The temperature to which the toner is heated can vary as a function of the composition of the toner. However, the temperature is generally about 190 degrees, Centigrade. The step of heating the toner can also be accompanied by the step of applying pressure to the heated toner to aid in fusing the heated toner to the medium.

With reference to FIG. 1, a schematic view is shown of a typical prior art image-producing device 10. The device 10 typically comprises a production/transfer portion 12 which is configured to produce an image (not shown) and which is also configured to transfer the image onto a sheet of medium "M" such as a sheet of paper or the like. The prior art device 10 can also typically comprise a feed mechanism 22 which is configured to feed the medium "M" through the device 10 at a substantially constant rate of speed. The feed mechanism 22 can comprise a pair of substantially parallel rollers 24 or the like, between which the medium "M" is captured and fed.

The device 10 also typically comprises a medium sensor 32 which is configured to detect the presence of the leading edge "LE" of the medium "M" and can also be configured to detect the trailing edge "TE" of the medium as well. As shown, the device 10 can also comprise a fusing portion 42 which is configured to substantially fuse the image to the medium "M." When I say "fuse" I mean a process by which an image is substantially fixed or bonded to a medium, wherein the process is performed in conjunction with the use of an image-producing device.

The fusing portion 42 can comprise a heater 44 as well as a pressure roller 46 between which the medium "M" is passed to fuse the image thereto. The pressure roller 46 can be driven by way of a motor or the like (not shown) so as to assist the feed mechanism in moving the medium "M" along the feed path "F." In addition, the fusing portion 42 can comprise a temperature sensor 48 which is configured to detect the temperature of the heater 44.

The prior art device 10 can also comprise a controller 52 which is in communication with at least one of the above-described components 12, 22, 32, 42 by way of respective communication links 60. The controller 52 is configured to control various operational aspects of the prior art device 10. The controller 52 can comprise a data storage memory 54 which is configured to store various data. The controller 52 can also include a processing portion 55 which is configured to make operational decisions based on various operational parameters. Various algorithms 56, 57 can also be included in the controller 52. The algorithms 56, 57 can be configured to carry out specific operational functions of the device 10.

The production/transfer portion 12, the feed mechanism 22, the sensor 32, and the fusing portion 42 are supported on a structural base (not shown) or the like so as to each have substantially fixed locations relative to one another. The medium "M" is fed through the device 10 along the feed path "F." As mentioned above, the feed mechanism 22 is configured to feed the medium "M" through the device 10 and along the feed path "F" at a substantially constant rate of speed.

The physical distances along the feed path "F" and between the various components is generally know. For example, the distance "D" along the feed path "F" and between the sensor 32 and the production/transfer portion 12 is known. Because the rate of speed of the medium "M" along the feed path "F" is known, as well as the distance between the sensor 32 and the production/transfer portion 12, the position of the medium relative to the production/transfer portion can be determined as a function of time.

For example, once the medium "M" is captured by the feed mechanism 22, the speed of the medium along the feed path "F" is known. The sensor 32 can substantially detect the exact moment that the leading edge "LE" of the medium "M" passes the sensor, at which moment a timer can be started. The quotient of the rate of speed of the medium "M" along the feed path "F" divided by the distance "D," represents the elapsed time between the moment the leading edge "LE" passes the sensor 32 and the moment at which the leading edge "LE" reaches the production/transfer portion 12.

That is, the time at which the leading edge "LE" reaches the production/transfer portion 12 can be determined by dividing the rate of speed of the medium "M" along the feed path "F" by the distance "D" between the sensor 32 and the production/transfer portion. In this manner, the location of the medium "M" along the feed path "F," and relative to the production/transfer portion 12, can be determined. The location of the medium "M" along the feed path "F" can be essential for the accurate placement of the image onto the medium by the production/transfer portion 12.

After the image is transferred to the medium "M" at the production/transfer portion 12, the medium continues along the feed path "F" to the fusing portion 42 where the image is fused to the medium. As discussed above, the fusing portion 42 comprises a heater 44 and a pressure roller 46. The medium "M" travels along the feed path "F" and between the heater 44 and the pressure roller 46 as the image is fused to the medium.

Typically, the fusing portion 42 is configured so that the heater 44 is maintained at a temperature set point as a sheet of medium feeds through the fusing portion. By "temperature set point" I mean a given temperature at which the heater surface is maintained. In prior art devices such as the device 10, the temperature set point is generally substantially constant with respect to any given sheet of medium "M." That is, the temperature set point of prior art devices is configured to remain substantially constant as a given sheet of medium "M" feeds through the fusing portion 42.

The temperature set point is usually maintained by way of a feedback control loop or the like. Feedback control loops are well known in the art and are generally employed to automatically maintain an ideal, or "target," operational parameter of a given system in response to unpredictable external factors which affect the operational parameter. Feedback control loops typically employ at least one sensor which is configured to detect and measure an actual characteristic of the operational parameter in order to compare the actual characteristic to an ideal characteristic. One well-know example of a feedback control loop is the temperature control system of a residential heating system. This system is often referred to as a "thermostat."

The thermostat acts as a feedback control loop to maintain the inside temperature of a house within a given range and in response to external, ambient temperatures. The ambient temperature affects the rate of heat loss through the walls of the house. That is, relatively low, or cold, ambient temperatures result in a greater rate of heat loss through the walls of the house as compared to relatively higher, or warmer, ambient temperatures. As heat is lost through the walls of a house, the interior temperature of the house falls. The thermostat acts as a sensor to monitor the interior temperature of the house.

When the thermostat detects that the interior temperature has fallen below a given minimum acceptable point, the thermostat causes the heating unit to begin producing heat which is distributed within the interior of the house so as to raise the interior temperature. The heating unit is usually caused to operate until the interior temperature rises to a given maximum temperature at which time the heating unit stops producing heat. The maximum temperature is generally several degrees higher than the minimum acceptable temperature. This process is repeated indefinitely as the heat is lost through the walls of the house.

The ideal temperature, at which the thermostat is set, is usually midway between the minimum acceptable temperature and the maximum temperature. The range between the minimum acceptable temperature and the maximum temperature is usually determined as the result of a compromise between the ability to maintain a comfortable interior temperature and an excessive rate of on/off cycling of the heating unit.

In other words, as the range between the maximum temperature and the minimum acceptable temperature is increased, the heating unit will cycle on and off less frequently, but the interior of the house will be subject to a greater variation of temperatures. On the other hand, as the range between the maximum and minimum temperatures decreases, the interior temperature will remain closer to the ideal temperature, but the heating unit will cycle on and off frequently.

Referring to FIG. 1, the feedback control loop of the fusing portion 42 can operate in a manner similar to the example discussed above. The heat sensor 48 can be configured to detect the temperature of the heater 44. The heat sensor 48 can then convert the detected temperature to a signal which is sent by way of the respective communication link 60 to the controller 52. The controller 52 can receive the signal and read the temperature.

The controller 52 can then compare the detected temperature of the heater 44 to the ideal "temperature set point" which can be stored or programmed into the controller. If the controller 52 determines that the detected temperature of the heater 44 is below the set point, then the controller sends a signal to the heater which instructs the heater to increase its temperature by producing heat. Conversely, if the controller 52 determines that the detected temperature of the heater 44 is above the set point, then the controller instructs the heater to stop producing heat. Thus, the controller 52, in conjunction with the heat sensor 48, can act as a feedback control loop to maintain the temperature of the heater 44 at, or substantially near, the temperature set point.

Turning now to FIG. 2, a prior art flow diagram 70 is shown. The flow diagram 70 represents one possible prior art control scheme for controlling the fusing portion 42 (shown in FIG. 1) in conjunction with the overall operation of the prior art image-producing device 10 (also shown in FIG. 1). It is understood that many variations of flow diagram 70 are possible. With reference to both FIGS. 1 and 2, the flow chart 70 begins at step S71. In step S72, the controller 52 is notified that medium "M" is ready to proceed through the device 10 along the feed path "F."

In accordance with step S73, and in preparation for allowing the medium "M" to proceed along the feed path "F," the controller 52 sends a signal to the heater 44 which instructs the heater to increase its temperature to the temperature set point. Moving to step S74, the temperature of the heater 44 is monitored. When the heater 44 attains the temperature set point, the medium "M" is allowed to proceed into the device 10 and along the feed path "F."

The next step in the flow diagram is step S75 in which the temperature of the heater 44 is monitored. Corrections to the temperature of the heater 44 are made as necessary in order to maintain the heater at the temperature set point. During step S75, medium continues to proceed through the device 10 along the feed path "F." The step S76 queries whether more medium is to be processed through the device 10.

If the answer to the query of step S76 is "yes," then the path of the flow diagram returns to the previous step of S75, wherein the temperature of the heater 44 is monitored and maintained at the temperature set point. However, if the answer to the query of step S76 is "no," then the flow diagram moves to the next step which is step S77. In step S77 the controller 52 instructs the heater 44 to shut off. The flow diagram ends with the next step, which is step S78.

Referring again to FIG. 1, it is evident that the heater 44 is located in very close proximity to the pressure roller 46. Moreover, it is preferable in most cases for the heater 44 and the pressure roller 46 to be resiliently biased against one another to ensure optimal heat transfer from the heater 44 to the medium "M" during fusing of the image thereto. The heater 44 and pressure roller 46 can be resiliently biased against one another through the incorporation of a spring or the like (not shown). Thus, when no medium "M" is between the heater 44 and the pressure roller 46, there is contact there between.

As a result of the contact between, or at least the close proximity of, the heater 44 and the pressure roller 46, heat energy is transferred from the heater 44 to the pressure roller 46. That is, when the heater 44 is producing heat energy, the temperature of the pressure roller 46 increases due to the contact between, or close proximity of, the heater and the pressure roller. However, this increase in temperature of the pressure roller 46 occurs only when no medium "M" is feeding through the fusing portion 42 and between the heater 44 and the pressure roller.

As discussed above, the temperature the heater 44 is maintained in a substantially precise temperature set point. The substantially precise temperature set point is necessary in order to optimize the fusing process in which a substantially precise quantity of heat is required to properly fuse the image to the medium "M." As is evident from the above discussion for FIG. 2, the heater 44 must generally be at, or substantially near, the temperature set point before the medium "M" is allowed to proceed through the fusing portion. This is to ensure that the correct amount of heat energy is available to be transferred to the image and to the medium "M" as the medium and image are passed through the fusing portion 42 so as to fuse the image to the medium.

At a minimum, the heater 44 and the pressure roller 46 are in contact with, or in close proximity to, each other for a period of time during which the temperature of the heater is increased to the temperature set point. Thus, before the medium "M" feeds along the feed path "F" and between the heater 44 and the pressure roller 46, the pressure roller will have attained a temperature which is not negligible. That is, at the time the heater 44 attains the temperature set point, the pressure roller 46 has absorbed a significant amount of heat energy from the heater.

Immediately prior to the entry of the leading edge "LE" of the medium "M" into the device 10, the medium is at a temperature which is substantially equal to the ambient temperature. Since a typical temperature set point is about 190 degrees, Centigrade, the ambient temperature is generally much less than the temperature of the heater 44, and is typically less than 30 degrees, C. As the medium "M" is fed through the fusing portion 42, the heater 44 transfers heat to the much cooler medium to raise the temperature of the medium and the image for the fusing thereof. As the heater 44 loses heat energy to the medium "M," the controller 52 maintains the temperature set point by controlling the quantity of heat produced by the heater as discussed above.

As discussed above, the pressure roller 46 is at a significantly high temperature relative to the medium "M" when the medium begins to pass between the heater 44 and the pressure roller. The temperature of the pressure roller 46 can be substantially near the temperature set point, although it can also be somewhat less than the temperature set point. In any case, the temperature of the pressure roller 46 will generally be significantly greater than the temperature of the medium "M" when the medium first begins to pass between the heater 44 and the pressure roller.

Because the temperature of the pressure roller 46 is greater than the medium "M," heat energy is transferred from the pressure roller 46 to the medium as the medium passes between the heater 44 and the pressure roller. That is, the medium "M" absorbs heat energy from both the heater 44 on one side and the pressure roller 46 on the opposite side. However, unlike the heater 44 which remains at the temperature set point as the medium "M" passes through the fusing portion 42, the temperature of the pressure roller 46 decreases as heat energy is transferred from the pressure roller to the medium. In other words, the temperature of the pressure roller 46 decreases as a function of the position along the feed path "F" of the medium "M" relative to the fusing portion 42.

More specifically, as the medium "M" passes farther through the fusing portion 42, the temperature of the pressure roller 44 gets lower. This is because the pressure roller 46 absorbs heat energy from the heater 44 only when the medium "M" is not between the heater and the pressure roller, and if the portion of the medium immediately adjacent to the pressure roller is at a temperature that is lower than that of the pressure roller. Conversely, when the medium "M" is between the heater 44 and the pressure roller 46, heat is transferred from both of the relatively hot heater 44 and relatively hot pressure roller 46 to the relatively cool medium "M." After the trailing edge "TE" of the medium "M" passes completely through the fusing portion 42, the pressure roller 46 again absorbs heat energy from the heater 44, which causes the temperature of the pressure roller to again increase.

Because the temperature of the pressure roller 46 decreases as the medium "M" passes through the fusing portion 42, the capacity of the pressure roller to transfer heat energy to the medium "M" decreases as well. In turn, because the heat transfer capacity of the pressure roller 46 decreases as the medium passes through the fusing portion 42, the leading edge "LE" of the medium "M" absorbs more heat energy than the trailing edge "TE."

Generally, the quantity of heat energy absorbed by the medium "M" at a given position thereon is inversely proportional to the distance between the given position and the leading edge "LE" of the medium. For example, a given position on the medium "M" that is substantially midway between the leading edge "LE" and the trailing edge "TE" will absorb a given quantity of heat energy that is less than the quantity of heat energy that is absorbed by the medium at the leading edge, and more than the quantity of heat absorbed by the medium at the trailing edge.

As indicated by the above discussion, the medium "M" absorbs heat energy in varying quantities during the fusing process, wherein the quantity of heat absorbed by the medium is dependent upon the extent that the medium has passed through the fusing portion 42. That is, as the medium passes through the fusing portion 42, the quantity of heat transferred to the medium "M" from the fusing portion decreases due to the decreasing temperature of the pressure roller 46. This can result in inconsistent adhesion of the image to the medium "M" because, at best, only a portion of the image can be exposed to the optimum quantity of heat energy.

As is evident, problems are associated with the use of prior art image-producing devices which incorporate the above-illustrated fusing methods and apparatus. What is needed then, are methods and apparatus which achieve the benefits to be derived from similar prior art devices, but which avoid the shortcomings and detriments individually associated therewith.

SUMMARY OF THE INVENTION

The invention includes methods and apparatus for fusing images to medium in conjunction with the use of an image-producing device.

In accordance with a first embodiment of the present invention, an apparatus for fusing an image to a medium comprises a heat source to which the image and medium is exposed as the medium and image are fed through an image-producing device. The heat source is configured to increase in temperature as the medium and image are exposed thereto.

In accordance with a second embodiment of the present invention, a method of fusing an image to a medium includes providing a heat source and increasing the temperature of the heat source while the image and medium are exposed to the heat source.

In accordance with a third embodiment of the present invention, another method of fusing an image to a medium includes providing a heat source and a pressure roller. The image and medium is passed between the pressure roller and the heat source while the temperature of the heat source is increased.

DETAILED DESCRIPTION OF THE INVENTION

The invention includes apparatus and methods for fusing an image to a medium in conjunction with the use of an image-producing device. The apparatus is provided with a heat source which is used to heat the medium and toner supported thereon to facilitate fusing of the toner to the medium. The invention generally includes increasing the temperature of the heat source as the medium passes the heat source. This produces a more consistent quantity of heat energy transferred to the medium, which results in a more consistent fusing process and better adhesion of the toner to the medium.

Figure 1:
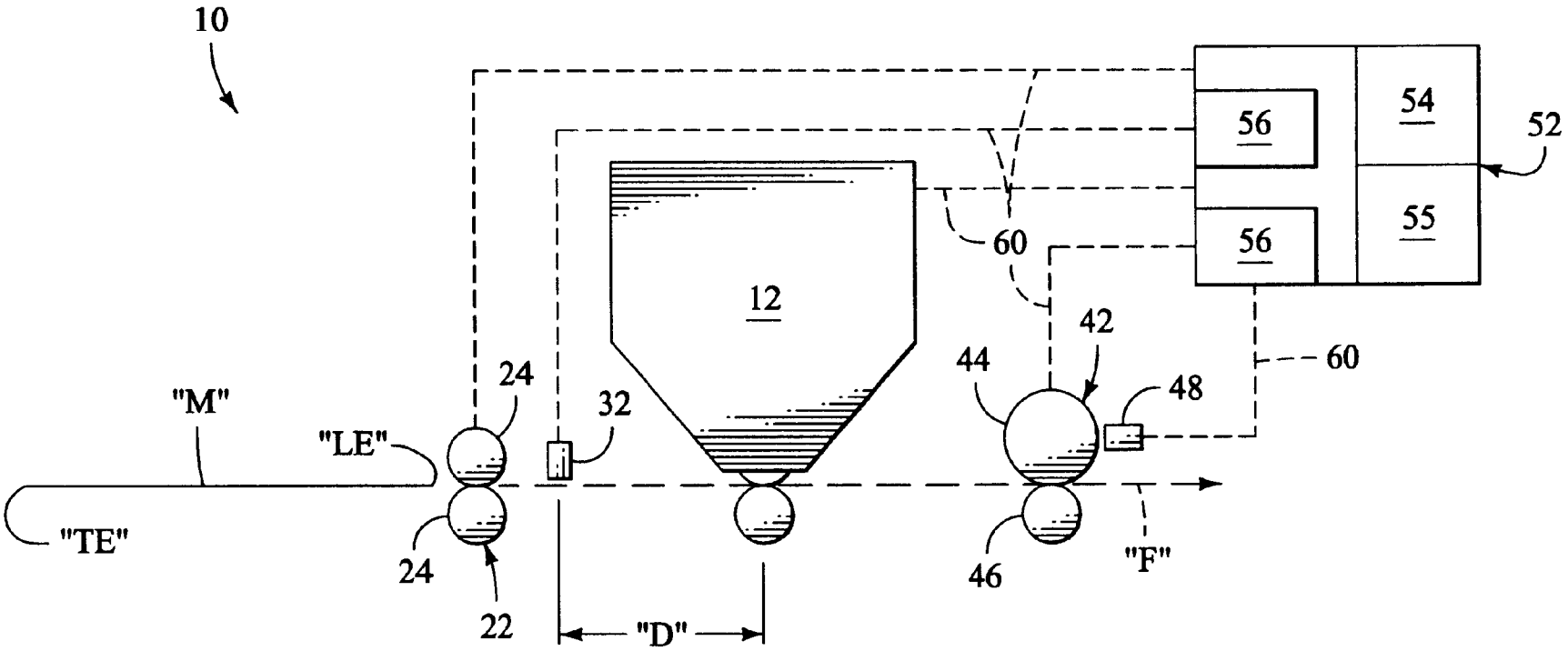
FIG.1 PRIOR ART
FIG. 1 is a schematic diagram of a prior art image-producing device.
Figure 3:
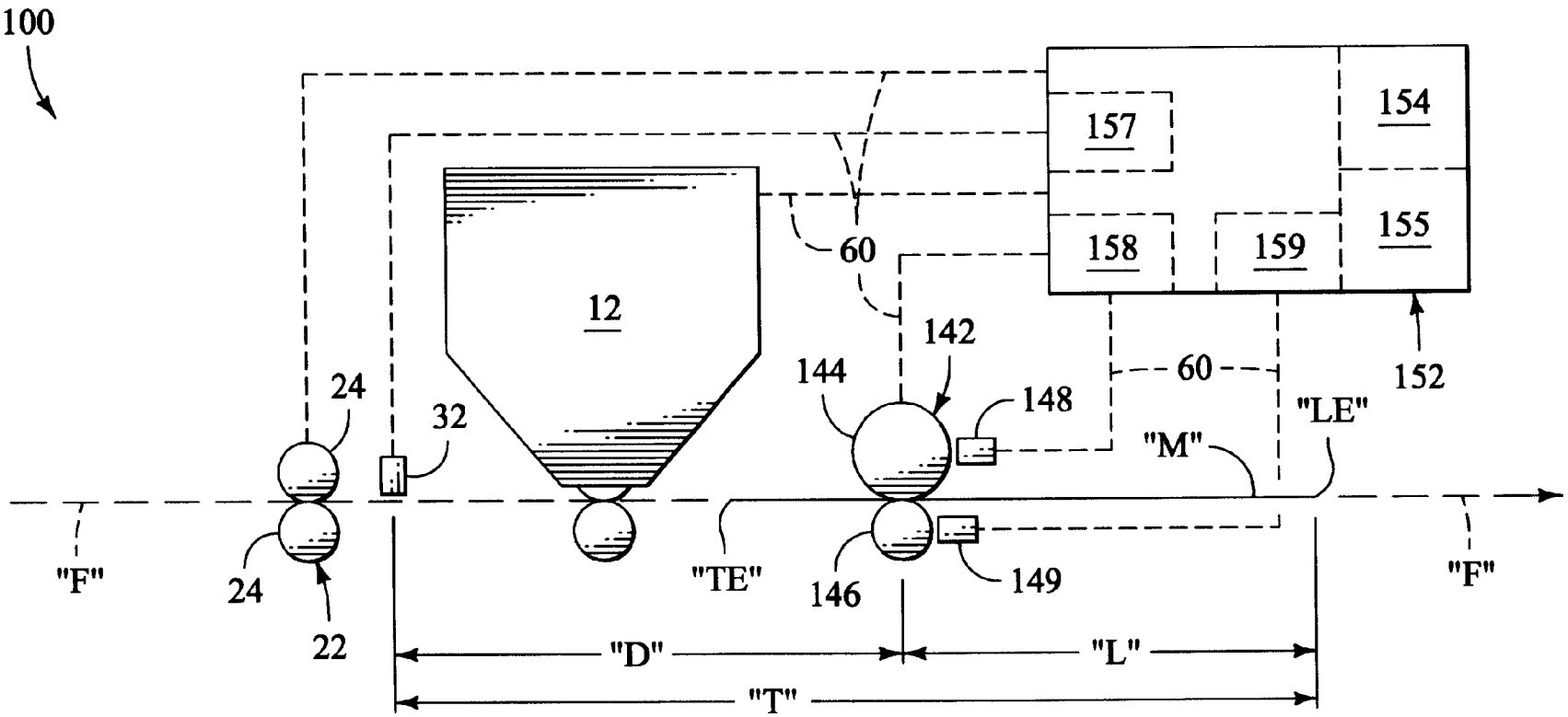
FIG. 3 is a schematic diagram of a fusing apparatus in accordance with the first embodiment of the present invention.

Turning to FIG. 3, a schematic diagram is shown of an apparatus 100 in accordance with a first embodiment of the present invention. The apparatus 100 is configured to provide an improved fusing process by exposing both an image comprising toner and medium, to which the toner is to be affixed, to a substantially consistent quantity of heat energy during the fusing process. As is seen, the apparatus 100 can be generally configured in a manner similar to that of the prior art device 10 which is described above for FIG. 1, but with the several differences which will now be discussed in detail.

Figure 2:
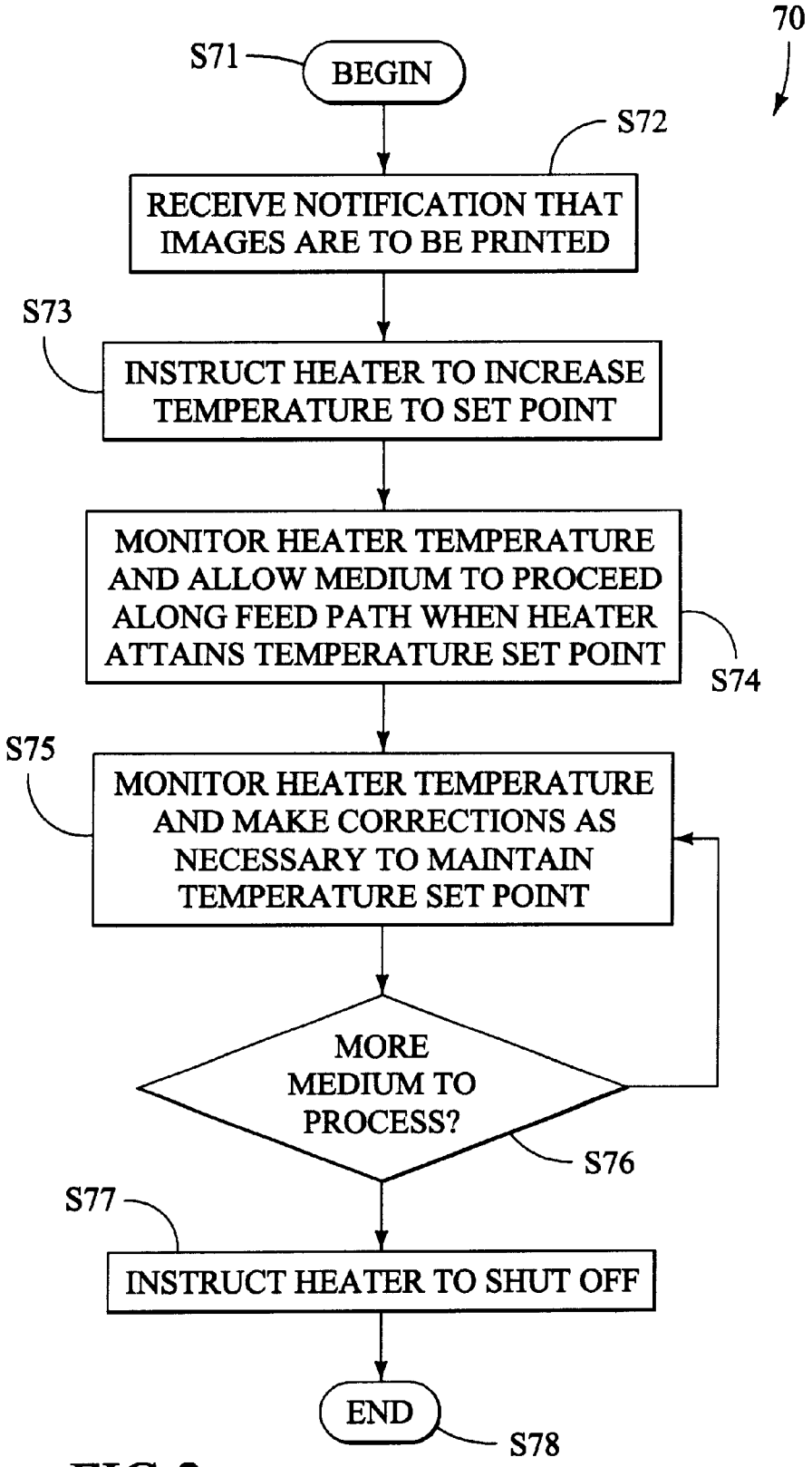
FIG.2 PRIOR ART
FIG. 2 is a prior art flow diagram which represents a typical operational scheme for the image-producing device depicted in FIG. 1.

The apparatus 100 can comprise an image production/transfer portion 12, along with a feed mechanism 22, and a medium sensor 32. The feed mechanism 22 can include a pair of rollers 24 or the like. The production/transfer portion 12, feed mechanism 22, and the medium sensor 32 can be configured as described above for FIGS. 1 and 2.

That is, the image production/transfer portion 12 can be configured to produce an image (not shown) by selective deposition of a substance, such as a toner, onto a surface, such as a photoconductor, and to transfer the image onto a medium "M" which is moved along the feed path "F" by the feed mechanism 22. The medium sensor 32 can be configured to detect the leading edge "LE" of the medium "M" during movement thereof along the feed path "F" and past the sensor. The sensor 32 can also be configured to detect the trailing edge "TE" of the medium "M" during movement thereof along the feed path "F" and past the sensor.

The apparatus 100 also comprises a fusing portion 142 which includes a heat source 144 which is configured to increase in temperature while the transferred image and the medium "M" are passed by the heat source on the feed path "F." The fusing portion 142 can also include a heat source temperature sensor 148 which is configured to detect and measure the temperature of the heat source 144. The sensor 148 is also configured to convert the measured temperature of the heat source 144 into a signal as will be discussed in greater detail below.

The fusing portion 142 can include a pressure roller 146 which is located substantially proximate the heat source 144. Both the heat source 144 and the pressure roller 146 can be located relative to the feed path "F" so that the medium "M" passes between the heat source and the pressure roller as shown. The pressure roller 146 can be driven by way of a motor or the like (not shown) so as to assist the feed mechanism 22 in moving the medium "M" along the feed path "F."

The fusing portion 142 can also include a pressure roller temperature sensor 149 which is positioned substantially proximate the pressure roller 146 and which is configured to detect and measure the temperature of the pressure roller. The pressure roller temperature sensor 149 can also be configured to convert the measured temperature of the pressure roller 146 into a signal as will be discussed in greater detail below.

The apparatus 100 can also comprise a controller 152 which can include a data storage memory 154 which is configured to store data. The controller 152 can also include a processing portion 155 which is configured to perform operational functions such as performing calculations and the like and making operational decisions based on various operational parameters. For example, the processing portion 155 can be configured to control the temperature of the heat source 144.

The controller 152 can also include a plurality of algorithms 157, 158, 159 which can be employed to carry out various operational procedures of the apparatus 100. At least one of the algorithms 157, 158, 159 can be configured to cause the temperature of the heat source 144 to increase while the image and the medium "M" are passed by the heat source.

Each of the various components 12, 22, 32, 142 of the apparatus 100 can be in communication with the controller 152 byway of a respective communication link 60. It is understood that the communication links 60 can comprise any of a number of known means of transmitting data between two points, such as wire, fiber optic, radio wave, infrared wave, and sound wave means.

As is seen, a medium "M" can be moved through the apparatus 100 along the feed path "F." The medium "M" can be moved along the feed path "F" by the feed mechanism 22 at a substantially known speed. Preferably, the speed at which the medium is moved along the feed path "F" is a substantially constant speed. The medium "M" is moved past the medium sensor 32 which can detect when the leading edge "LE" of the medium passes the sensor on the feed path "F" and can also detect the trailing edge "TE" of the medium in a similar manner.

The sensor 32 can send a signal to the controller 152 at the moment the leading edge "LE" of the medium "M" is detected. The controller 152 can start a timer (not shown) at the moment the signal is received from the sensor 32. Preferably, the positions of the components of the apparatus 100 are substantially fixed relative to one another such that the distances between the components along the feed path "F" are both known and constant. For example, the distance "D" along the feed path "F" and between the sensor 32 and the fusing portion 142 is constant and is known.

Thus, once the leading edge "LE" of the medium "M" passes, and is detected by, the sensor 32, then the position of the leading edge relative to the fusing portion 142 can be determined. For example, if the leading edge "LE" is detected by the sensor 32 and if a given time interval elapses after the detection of the leading edge by the sensor, then the total distance "T" between the sensor and the leading edge can be determined by multiplying the speed of the medium "M" along the feed path "F" by the given time interval.

Once the total distance "T" between the leading edge "LE" and the sensor 32 is determined, then the length "L" between the leading edge and the fusing portion 142 can be determined. Since the distance "D" between the sensor 32 and the fusing portion 142 is know, then the length "L" is found by subtracting the distance "D" from the total distance "T." Such calculations of the position of the leading edge "LE" of the medium "M" can be performed by the processor 155.

The image and the medium "M" are preferably exposed to a substantially precise and substantially consistent quantity of heat energy as the image and medium proceed through the fusing portion 142 along the feed path "F." Preferably, the temperature of the heat source 142 reaches a given temperature set point before the medium and image are exposed to the heat source. Due to the proximity of the pressure roller 146 and the heat source 144 to one another, heat energy is transferred to the pressure roller from the heat source as the temperature of the heat source is increased to the temperature set point.

As the medium "M" and the image are moved along the feed path "F" and between the heat source 144 and the pressure roller 146, heat energy is transferred from the both the heat source and the pressure roller to the medium and the image. Because the pressure roller 146 is not a source of heat, but receives heat energy from the heat source 144, the temperature of the pressure roller decreases as heat energy is transferred from the pressure roller to the medium "M" and to the image.

Thus, to compensate for the temperature decrease experienced by the pressure roller 146, the temperature of the heat source 144 can be caused to increase as the medium "M" and the image pass between the heat source and pressure roller along the feed path "F." That is, the heat source 144 is configured to increase in temperature while the image and the medium "M" are passed by the heat source. This increase in temperature of the heat source 144 can be accomplished by causing the heat source 144 to incrementally increase the amount of heat energy produced thereby.

As mentioned above, the heat source sensor 148 is configured to detect and measure the temperature of the heat source 144. The sensor 148 can be further configured to convert the detected and measured temperature into a signal which can be sent to the controller 152 by way of the respective communication link 60. The sensor 148 can be employed in conjunction with the controller 152 and respective communication links 60 to act as a feedback control loop to substantially control the temperature of the heat source 144. The principles of operation of feedback control loops have been discussed above.

The sensor 148 can detect and measure the temperature of the heat source 144. The temperature of the heat source 144 can then be converted to a signal which is sent from the sensor 148 to the controller 152. The controller 152 receives the signal from the sensor 148 and compares the actual detected temperature of the heat source 144, as measured by the sensor, to an ideal, or target, temperature. If the actual temperature of the heat source 144 is below the ideal temperature, the controller 152 can then send a signal to the heat source which instructs the heat source to increase its temperature. Conversely, if the actual temperature of the heat source 144 is above the ideal temperature, the controller 152 can then cause the temperature of the heat source to decrease.

Because the temperature of the heat source 144 is intended to increase as the image and the medium "M" pass through the fusing portion 142, the controller 152 can compare the actual increasing temperature of the heat source to a set of ideal temperatures which make up an ideal temperature profile of the heat source. That is, the controller 152 compares the actual temperature of the heat source 144 to incrementally increasing ideal temperature values in order to ensure that the heat source is increasing in temperature at the proper rate.

One method of increasing the temperature of the heat source 144 is by increasing the temperature of the heat source as a function of the position of the medium "M" relative to the heat source. For example, the temperature of the heat source 144 can be increased as a function of the position of the leading edge "LE" of the medium "M" relative to the heat source. The position of the leading edge "LE" of the medium "M" relative to the heat source 144 can be represented by the length "L" which can be determined as discussed above.

The value of the length "L" increases as the medium "M" progresses through the fusing portion 142 and along the feed path "F." Thus, the temperature of the heat source 144 can be increased in direct proportion to the value of "L." That is, the heat source 144 can reach an initial temperature set point before the leading edge "LE" of the medium "M" passes between the heat source and the pressure roller 146. When the leading edge "LE" of the medium "M" reaches the heat source 144, the controller 152 can note this event, and can then cause the temperature of the heat source to begin increasing at a given rate so that, when "L" is equal to a given length, the temperature of the heat source has increased by a corresponding given amount.

As the medium "M" progresses through the fusing portion 142, the controller 152 can substantially continually compare the actual temperature of the heat source 144 to an ideal temperature which corresponds to the actual value of the length "L." For example, the controller 152 can be configured to cause the temperature of the heat source 144 to increase at the rate of 0.5 degrees, Centigrade, per inch medium "M." Thus, for example, when the length "L" is equal to 0.5 inch, the temperature of the heat source should be 0.25 degrees, Centigrade, greater than the initial temperature set point.

Continuing with the above example, the temperature of the heat source 144 should be at a temperature which is 1.0 degree, Centigrade, greater than the initial temperature set point when the length "L" is equal to 2.0 inches. Therefore, for example, when the length "L" reaches a value of 2.0 inches, the controller 152 notes that the ideal temperature of the heat source 144 is a temperature which is 1.0° C. higher than the initial temperature set point and then makes a comparison with the actual temperature of the heat source as measured by the sensor 148.

One exemplary temperature profile for sheet of paper medium that is eleven inches in length is as follows:

| Distance From Top of Sheet | Temperature (Degrees, Centigrade) |
|---|---|
| 0–1 inches | 190.0 |
| 1–2 inches | 190.5 |
| 2–3 inches | 191.0 |
| 3–4 inches | 191.5 |
| 4–5 inches | 192.0 |
| 5–6 inches | 192.5 |
| 6–7 inches | 193.0 |
| 7–8 inches | 193.5 |
| 8–9 inches | 194.0 |
| 9–10 inches | 194.5 |
| 10–11 inches | 195.0 |

If the actual temperature of the heat source 144 is below the ideal temperature, then the controller 152 can cause an increase in the rate of temperature increase of the heat source. Likewise, if the actual temperature of the heat source 144 is above the ideal temperature, then the controller 152 can cause a decrease in the rate of temperature increase of the heat source.

This process, as described above, of comparing the actual temperature of the heat source 144 with an ideal temperature as a function of the position of the medium "M" relative to the fusing portion 142 can be performed by the controller 152 on a substantially continual basis. That is, the temperature comparison and adjustment process can be performed as often as the processing speed of the controller 152 will allow. Alternatively, the temperature comparison and adjustment process can be performed at set intervals. For example, the process can be performed at a given time interval, such as every half second. As an additional example, the process can be performed at intervals based on the position of the medium "M" relative to the fusing portion 142, such as every 0.25 inch of length of medium.

The temperature of the heat source 144 can also be based on the temperature of the pressure roller 146. That is, the controller 152 can adjust the temperature of the heat source 144 based on the actual temperature of the pressure roller 146 as detected and measured by the pressure roller temperature sensor 149. This technique is advantageous since it tends to accommodate differences in heat capacities of various types of medium onto which the image can be affixed. For example, relatively thick paper medium and transparencies can tend to absorb more heat energy from the pressure roller 146 than relatively thin paper medium. Such higher heat energy absorption rates of more massive medium can result in a higher rate of temperature drop in the pressure roller 146.

One method of employing measurements of the actual temperature drop of the pressure roller 146 is to cause the temperature of the heat source 144 to be increased in a manner which will directly offset the decrease in temperature experienced by the pressure roller. For example, the sensor 149 can detect and measure the temperature of the pressure roller 146 at the moment the leading edge "LE" of the medium "M" enters the fusing portion 142.

The sensor 149 can then convert the temperature measurement to a signal which is sent by way of the respective communication link 60 to the controller 152. The controller 152 can receive the signal sent from the sensor 149 and read the actual temperature measurement of the pressure roller 146 as measured by the sensor. The controller then notes this initial temperature of the pressure roller and can then store this initial temperature reading in the data memory 154.

After the medium "M" progresses through the fusing portion 142 for a given length "L" the controller 152 again receives a second temperature measurement of the pressure roller 146 from the sensor 149. The controller 152 can then subtract the second temperature measurement from the initial temperature measurement to calculate a decrease in temperature of the pressure roller. The controller 152 can then send a signal to the heat source 144 which instructs the heat source to increase its temperature by the amount of the decrease in the temperature of the pressure roller 146.

This procedure, wherein the controller 152 calculates the decrease in temperature of the pressure roller 146 and cause a corresponding increase in the temperature of the heat source, can be performed on a substantially continual basis. Alternatively, the procedure can be performed at given intervals. It is understood that the temperature of the heat source 144 need not be increased by an amount that will substantially directly offset the decrease in the temperature of the pressure roller 146.

That is, the temperature of the heat source 144 need not be increased in a direct one-to-one ratio to the decrease in temperature of the pressure roller 146. For example, the temperature of the heat source 144 can be increased more than the amount of the temperature decrease experienced by the pressure roller 146. Conversely, the temperature of the heat source 144 can be increased less than the amount of the temperature decrease experienced by the pressure roller 146.

Figure 4:
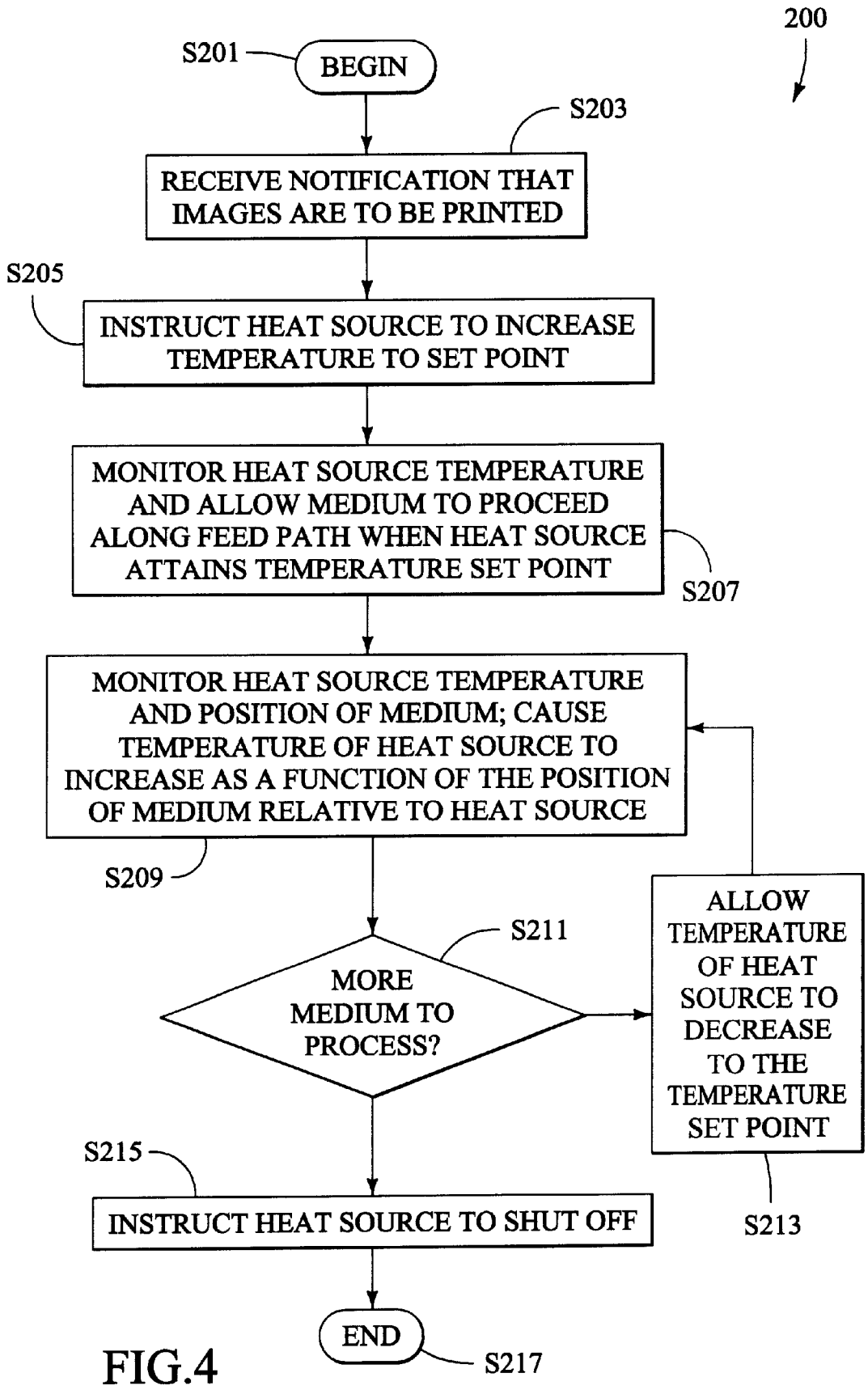
FIG. 4 is a flow diagram which represents one possible operational scheme for the apparatus which is depicted in FIG. 3.

Moving now to FIG. 4, a flow diagram 200 is shown. The flow diagram 200 represents one possible control scheme for controlling the apparatus 100 which is described above for FIG. 3. With reference to FIGS. 3 and 4, in accordance with the flow diagram 200, the diagram begins at step S201. Moving to step S203, the controller 152 receives notification that images are to be printed. The controller responds in step S205 by instructing the heat source 144 to increase its temperature to the set point.

Moving to step S207, the controller 152 monitors the temperature of the heat source 144 and allows the medium "M" to proceed along the feed path "F" when the heat source attains the temperature set point. That is, the medium "M" is held and prevented from proceeding through the fusing portion 142 until the heat source 142 is substantially at the temperature set point. After the medium "M" is allowed to proceed, the next step is that of S209 in which the controller 152 monitors the temperature of the heat source 144, as well as the position of the medium relative to the heat source.

In accordance with step S209, the controller causes the temperature of the heat source 144 to increase as a function of the position of the medium "M" relative to the heat source. In other words, the controller 152 can cause the temperature of the heat source 144 to increase as a function of the value of "L," which is the distance between the heat source and the leading edge "LE" of the medium "M."

When the trailing edge "TE" of the medium "M" exits the fusing portion 142, the flow diagram 200 proceeds to the next step, which is that of S211. Step S211 queries whether additional medium "M" is to be processed through the fusing portion 142. If the answer to the query is "yes," then the flow diagram moves to step S213 in accordance with which the temperature of the heat source 144 is caused to decrease to substantially the temperature set point in preparation for a new medium "M" and image to be fused thereto.

After step S213 is completed, the flow diagram moves back again to step S207 and repeats that step along with the steps of S209 and S211 for the new medium "M" and image. If, at step S211, there is no additional medium "M" to be processed, then the flow diagram moves to step S215, in accordance with which the heat source 144 is instructed to shut off or to decrease in temperature. The flow diagram 200 then moves to the end, which is step S217.

Figure 5:
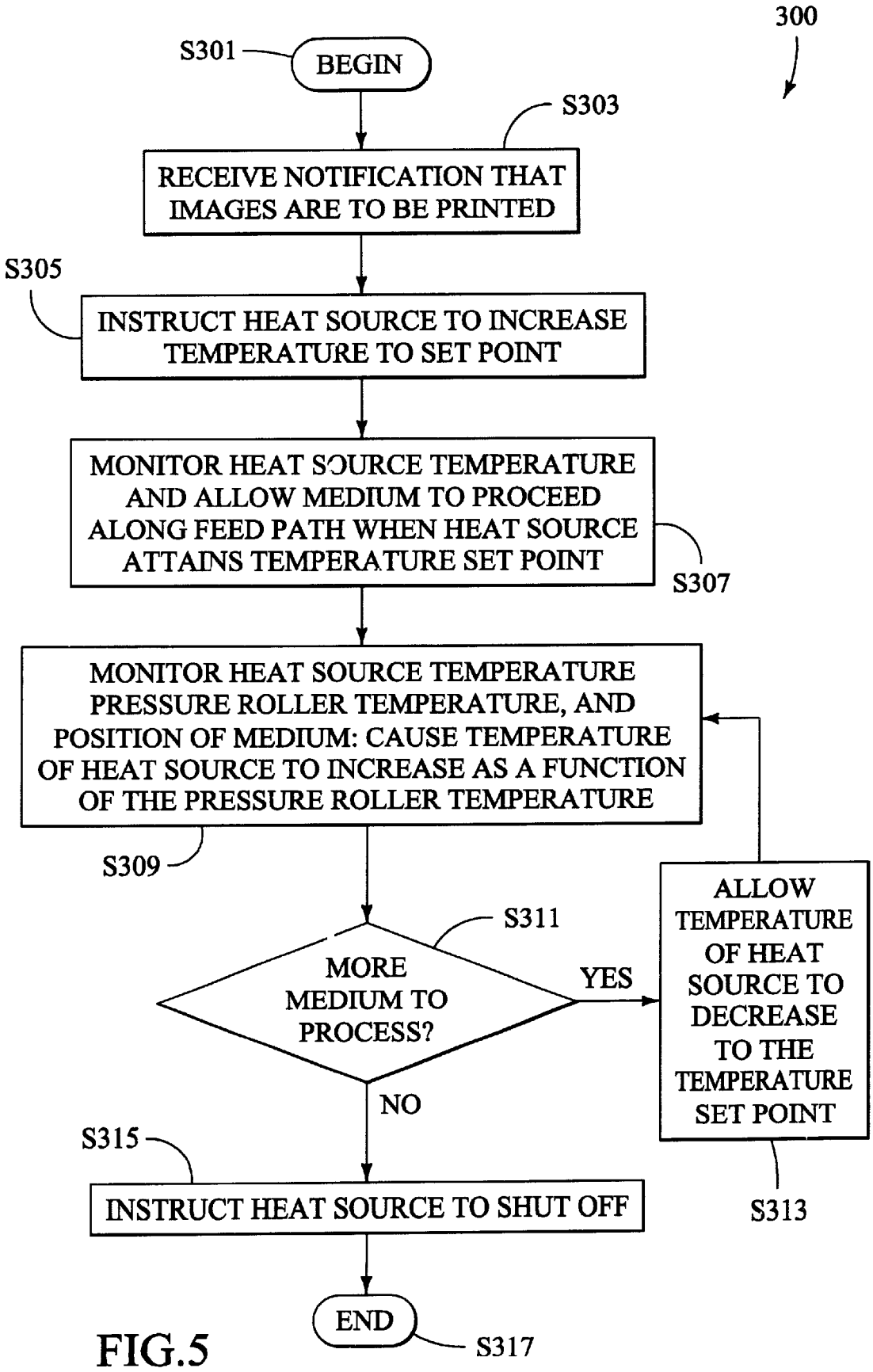
FIG. 5 is another flow diagram which represents another possible operational scheme for the apparatus which is depicted in FIG. 3.

Now moving to FIG. 5, a flow diagram 300 is shown. The flow diagram 300 is an alternative to the flow diagram 200 of FIG. 4, and represents another possible control scheme for controlling the apparatus 100 of FIG. 3. The flow diagram 300 begins at step S301. The next step in the flow diagram 300 is that of step S303, wherein the controller 152 receives notification that images are to be printed. In preparation for printing images, the controller 152 can instruct the heat source 144 to increase its temperature to the temperature set point in accordance with step S305.

The flow diagram 300 then moves to step S307, in accordance with which the controller 152 monitors the temperature of the heat source 144, and allows the leading edge "LE" of the medium "M" to proceed into the fusing portion 142 only after the heat source has attained the set point temperature. Next, in accordance with step S309, the controller 152 monitors the temperature of the heat source 144 as well as the temperature of the pressure roller 146. The controller 152 also monitors the position of the medium "M" relative to the fusing portion 142. In addition, the step S309 provides that the temperature of the heat source 144 is increased as a function of the temperature of the pressure roller 146 as the medium "M" passes through the fusing portion 142.

After the trailing edge "TE" of the medium "M" leaves the fusing portion 142, the flow diagram 300 moves from step S309 to step S311. Step S311 queries whether more medium "M" is to be processed through the fusing portion 142. If the answer to this query is "yes," then the flow diagram moves to the step S313, wherein the temperature of the heat source 144 is caused to decrease to the temperature set point.

From step S313, the flow diagram moves back to step S307 which is repeated for the new medium "M" along with steps S309 and S311. If the answer to the query of step S311 is "no," then the flow diagram 300 proceeds to step S315 in accordance with which the heat source 144 is instructed to shut off. After step S315, the flow diagram moves to the end which is step S317.

It is evident from the above discussion for FIGS. 3, 4, and 5, that increasing the temperature of the heat source 144 during movement of the image and medium "M" through the fusing portion 143 will improve the consistency of the quantity of heat energy that is transferred to the medium and to the image during the fusing process. The increase in temperature of the heat source 144 will increase the heat transfer capacity of the heat source to compensate for the decrease in heat transfer capacity of the pressure roller 146 which, in turn, is due to the temperature decrease thereof.

In accordance with a second embodiment of the present invention, a method of fusing an image to a medium is disclosed. It is understood that the image is generated by a substance such as toner which is deposited in one or more colors on the medium in a predetermined pattern so as to produce an image thereon. In accordance with the method of the second embodiment, a heat source is provided which can be employed to heat the toner and the medium, causing the toner to substantially fuse to the medium. The method also includes serially exposing the image and the medium to the heat source, and increasing the temperature of the heat source as the image is serially exposed to the heat source. That is, as the medium, with the image supported thereon, is moved past the heat source, the temperature of the heat source is increased. Alternatively, depending on the configuration of the apparatus in conjunction with which the method is to be practiced, the heat source can be moved past the medium as the temperature of the heat source is increased.

In one variation on the method, the temperature of the heat source can be increased at a substantially constant rate. In other words, the temperature of the heat source can be increased in a substantially linear manner. Alternatively, the temperature of the heat source can be increased in a non-linear manner. For example, the temperature of the heat source can be increased geometrically. As a further example, the temperature of the heat source can be increased substantially in accordance with a mathematical function such as a parabolic equation.

As the medium, with the image supported thereon, is moved past the heat source, the temperature of the heat source can be increased as a function of the distance between the leading edge of the medium and the heat source. That is, the temperature of the heat source can be increased as a function of the distance the medium travels past the heat source. This can include increasing the temperature of the heat source in direct proportion to the distance between the leading edge of the medium and the heat source.

For example, the temperature of the heat source can be increased about 0.5 degree, Centigrade, for each inch of distance between the leading edge of the medium and the heat source. The temperature of the heat source can alternatively be increased at a variable rate. That is, the temperature of the heat source can be increased by a given amount for each inch of distance between the leading edge and the heat source, wherein the given amount of increase falls within a given range. For example, the temperature of the heat source can be increased by an amount which is between about 0.25 and 1.0 degree, Centigrade, for each inch of distance between the leading edge of the medium and the heat source.

The temperature of the heat source can also be increased as a function of elapsed time. That is, the temperature of the heat source can be increased by a given amount for each unit of time that elapses from the moment the leading edge of the medium enters the fusing portion. This includes increasing the temperature of the heat source in direct proportion to elapsed time. For example, the temperature of the heat source can be increased about 0.5 degree, Centigrade, for each second of elapsed time.

In accordance with a third embodiment of the present invention another method of fusing an image to a medium is disclosed. This method includes providing both a heat source and a pressure roller. The method also includes passing the image and the medium, with the image supported thereon, between the heat source and the pressure roller. The temperature of the heat source is increased as the image and the medium are passed between the heat source and the pressure roller.

The temperature of the pressure roller can be monitored and detected, and the temperature of the heat source can be increased as a function of the temperature of the pressure roller. More specifically, a temperature set point can be defined, and the difference between the temperature set point and the temperature of the pressure roller can be determined.

The temperature of the heat source can then be increased to a value that is substantially equal to the sum of the temperature set point and the difference between the temperature set point and the temperature of the pressure roller. In other words, the difference between the temperature set point and the temperature of the pressure roller is added to the temperature set point to calculate the temperature to which the heat source is increased.

The difference between the temperature set point and the temperature of the pressure roller can be determined by one of several methods. One way to calculate the difference is to estimate the temperature of the pressure roller based on empirical test data. For example, an average temperature decrease per unit time of the pressure roller can be obtained from a number of test measurements. The test data can then be stored, for example, in the data storage memory of the controller from which it can be accessed for comparison to the temperature set point as a function of elapsed time.

Another method of determining the difference between the temperature set point and the temperature of the pressure roller is to physically detect and measure the temperature of the pressure roller and subtract this measurement from the temperature set point. In other words, the method of determining the difference can be based on detection and measurement of the temperature of the pressure roller.

An alternative method of maintaining a relatively constant level of heat energy transfer to a medium and image is to configure the pressure roller to produce heat energy along with the production of heat energy by the heat source. An apparatus in accordance with this method includes a pressure roller configured to be heated, as for example, by a device such as a separate internal heating element. Preferably, a temperature sensor is provided to monitor the temperature of the pressure roller and maintain the temperature thereof at a predetermined range or profile via a feedback control loop which is configured to control the heat output of the device employed to heat the pressure roller.

Yet another method of maintaining a relatively constant fusing temperature in the fusing portion of an image-producing device is to decrease the rate of travel of the medium through the fusing section as a function of the length of the medium which has passed through the fusing portion. That is, the farther along the medium has progressed through the fusing portion, the slower the medium moves relative to the fusing portion. This can allow the quantity of heat energy that flows into the medium and image from the fusing portion to remain relatively constant, even though the temperature that drives the transfer of heat energy into the medium and image decreases as the medium and image pass through the fusing portion.

An apparatus in accordance with this method can include a speed controller which acts in conjunction with a drive mechanism (i.e., the device that drives the medium through the fusing portion) to decrease the rate at which the medium is passed through the fusing portion. For example, the medium can be driven through the fusing portion by a pressure roller that is driven and powered directly by a drive motor, or indirectly by way of a drive linkage or the like.

The speed of the pressure roller can then be slowed by the speed controller to slowthe rate of travel of the medium and image through the fusing portion as a function of the portion of the medium which has already passed through the fusing portion. Furthermore, the speed controller can be coupled to a feedback control loop which receives a signal from a temperature sensor that is configured to detect and measure the temperature of the pressure roller.

As the temperature of the pressure roller decreases, the speed controller can thus cause the speed of the drive motor to decrease in order to slow the rate of travel of the medium through the fusing portion which, in turn, facilitates a substantially constant rate of heat flux from the heat source and the pressure roller into the medium and image.

In the case wherein the image-producing device is configured such that the toner is being applied to trailing portions of the medium concurrently with fusing the image to the medium at leading portion of the medium, then it may be appropriate to make adjustments in the image production/transfer portion to account for the eventual slowing of the medium as described above. For example, the production/transfer portion can comprise a laser imaging device having a scanning laser and an associated photoconductor. In this instance, the rate of scanning by the laser, as well as the rate of movement of the photoconductor relative to the laser, will typically need to be decreased along with the decrease in the rate of travel of the medium through the fusing portion.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of fusing an image to a medium, wherein the image is formed by a substance applied to the medium, comprising:

providing a heat source; and, exposing the image and the medium to the heat source while moving the image and the medium relative to the heat source; and, increasing a temperature of the heat source as the image and medium are moved relative thereto.

2. The method of claim 1, and wherein temperature of the heat source is increased at a substantially constant rate.

3. The method of claim 1, and wherein the medium is defined by a leading edge which is first exposed to the heat source, and further wherein the temperature of the heat source is increased as a function of a distance between the leading edge of the medium and the heat source.

4. The method of claim 1, and wherein the medium is defined by a leading edge which is first exposed to the heat source, and further wherein the temperature of the heat source is increased in direct proportion to a distance between the leading edge of the medium and the heat source.

5. The method of claim 1, and wherein the medium is defined by a leading edge which is first exposed to the heat source, and further wherein the temperature of the heat source is increased by an amount which is between about 0.25 degree, Centigrade, and 1 degree, Centigrade, for each inch of a distance between the leading edge of the medium and the heat source.

6. The method of claim 1, and wherein the medium is defined by a leading edge which is first exposed to the heat source, and further wherein the temperature of the heat source is increased by about 0.5 degree, Centigrade, for each inch of a distance between the leading edge of the medium and the heat source.

7. The method of claim 1, and wherein the medium is defined by a leading edge which is first exposed to the heat source, and further wherein the temperature of the heat source is increased as a function of time that elapses from the moment the leading edge passes the heat source.

8. The method of claim 7, and wherein the function is a substantially linear function.

9. The method of claim 7, and wherein the function is a temperature increase of about 0.5 degree, Centigrade, for each second of elapsed time.

10. A method of fusing an image to a medium, wherein the image is formed by a substance applied to the medium, comprising:

providing a heat source;

providing a pressure roller;

passing the image and the medium between the heat source and the pressure roller; and, increasing a temperature of the heat source as the image and the medium are passed between the heat source and the pressure roller.

11. The method of claim 10, and further comprising detecting the temperature of the pressure roller as the image and the medium are passed between the heat source and the pressure roller.

12. The method of claim 11, and wherein the temperature of the heat source is increased as a function of the temperature of the pressure roller.

13. The method of claim 11, and further comprising:

defining a temperature set point; and, determining the difference between the temperature set point and the temperature of the pressure roller.

14. The method of claim 13, and further comprising increasing the temperature of the heat source to a temperature that is substantially equal to the sum of the temperature set point plus the difference between the temperature set point and th temperature of the pressure roller.

15. The method of claim 13, and wherein the difference between the temperature set point and the temperature of the pressure roller is determined by estimation based on empirical test data.

16. The method of claim 13, and wherein the difference between the temperature set point and the temperature of the pressure roller is determined by measurement of the temperature of the pressure roller.

17. An apparatus for fusing an image to a medium wherein the image is formed by a substance applied to the medium, comprising a heat source configured to increase in temperature while the image and the medium are passed by the heat source.

18. The apparatus of claim 17, and further comprising an algorithm configured to cause the temperature of the heat source to increase while the image and the medium are passed by the heat source.

19. The apparatus of claim 18, and further comprising:

a pressure roller positioned substantially proximate the heat source, wherein the image and the medium passes between the heat source and the pressure roller; and, a sensor positioned substantially proximate the heat source, wherein the sensor is configured to detect the temperature of the pressure roller, and further wherein the algorithm is configured to increase the temperature of the heat source as a function of the temperature of the pressure roller as detected by the sensor.

20. An image-producing apparatus, comprising:

an image production/transfer portion;

a drive mechanism configured to move medium through the apparatus;

a position sensor configured to detect a leading edge of the medium; and, a fusing portion which is configured to increase in temperature as the medium passes the fusing portion.

21. The apparatus of claim 20, and wherein the fusing portion comprises:

a heat source which is configured to increase in temperature as the medium passes the fusing portion; and, a pressure roller, wherein the medium passes substantially between the pressure roller and the heat source when the medium passes the fusing portion.

22. The apparatus of claim 21, and further comprising a pressure roller temperature sensor which is configured to detect and measure the temperature of the pressure roller.

* * * * *